United States Patent [19]

Seidel et al.

[11] Patent Number: 4,840,573

[45] Date of Patent: Jun. 20, 1989

[54] MECHANISM FOR CONNECTING SHIELDING CAPS OF MULTI-POLE PLUGS TO THE GROUND POTENTIAL LAYERS OF A MOTHER BOARD

[75] Inventors: Peter Seidel, Groebenzell; Leo Pelzl, Holzkirchen; Karl Zell, Niederpoecking, all of Fed. Rep. of Germany

[73] Assignee: Siemens Aktiengesellschaft, Berlin and Munich, Fed. Rep. of Germany

[21] Appl. No.: 284,788

[22] Filed: Dec. 12, 1988

Related U.S. Application Data

[63] Continuation of Ser. No. 165,420, Feb. 29, 1988, abandoned, which is a continuation of Ser. No. 829,620, Feb. 14, 1986, abandoned.

[30] Foreign Application Priority Data

May 31, 1985 [DE] Fed. Rep. of Germany ..... 35195961

[51] Int. Cl.[4] ..... H01R 4/66

[52] U.S. Cl. ..... 439/92

[58] Field of Search ..... 439/65, 92, 108, 607–610

[56] References Cited

U.S. PATENT DOCUMENTS

| | | | |
|---|---|---|---|
| 2,762,025 | 9/1956 | Melcher | 339/143 R |
| 3,149,893 | 9/1964 | Dupre | 339/14 R |
| 3,329,925 | 7/1967 | Johnson et al. | 339/143 R |
| 4,389,080 | 6/1983 | Clark et al. | 339/14 R |
| 4,418,972 | 12/1983 | Benasuiti | 339/14 R |
| 4,451,107 | 5/1984 | Dola et al. | 339/143 R |

FOREIGN PATENT DOCUMENTS

| | | | |
|---|---|---|---|
| 0175942 | 4/1986 | European Pat. Off. . | |
| 2740684 | 7/1979 | Fed. Rep. of Germany . | |
| 161331 | 8/1979 | Netherlands | 339/14 R |

OTHER PUBLICATIONS

Teradyne Technical Bulletin No. 237; 1-29-85 P. C. Backplane Connectors.

*Primary Examiner*—Joseph H. McGlynn

[57] ABSTRACT

Spring elements are located at shielding caps of printed circuit board or cable connections such that they resiliently press against contact elements in the plugged condition, the contact elements being electrically connected to the ground potential layer of a mother board. Contact blades or reinforcing plates extending perpendicularly to the mother board serve as the contact elements. The spring elements, depending upon the position of the contact elements or the shape of the shielding caps are located at the insides or outsides of the shielding caps or are fashioned at the edges thereof which are directed towards the mother board.

9 Claims, 6 Drawing Sheets

MECHANISM FOR CONNECTING SHIELDING CAPS OF MULTI-POLE PLUGS TO THE GROUND POTENTIAL LAYERS OF A MOTHER BOARD

This is a continuation, of application Ser. No. 165,420, filed Feb. 29, 1988, now abandoned, which is a continuation, of application Ser. No. 829,620, filed Feb. 14, 1986, now abandoned.

BACKGROUND OF THE INVENTION

1. Field of the Invention

The present invention relates to a mechanism for electrically connecting shielding caps of multi-poled plugs to the ground potential layer of a mother board containing a plurality of contact members residing perpendicular thereto.

2. Description of the Prior Art

German patent No. 27 40 684, fully incorporated herein by this reference, discloses that the shielding cap of a cable is secured to a carrier board of an assembly and is electrically connected to the ground potential layer of a subrack via the contact elements when the cable plug is inserted. The contact elements are fashioned at the subrack as contact springs. The shielding caps are provided with suitable contact surfaces against which the contact springs press in the plugged condition of the plug and, therefore, electrically connect the shielding caps to the ground potential. This known apparatus does not comprise the shortest and, therefore, lowest resistance connection between the shielding cap and the ground potential layer of the mother board. Increased signal processing rates and, therefore, higher noise fields of the signal lines as well as the increasing number of plug poles require a more effective shielding of the plug and the plug connector strips.

SUMMARY OF THE INVENTION

The object of the present invention is to keep the connection between the shielding caps of multi-pole plugs and the ground potential layer of a mother board short and, therefore low resistant and also to fulfill the additional requirements.

Proceeding from a device of the type initially set forth, the resolution of this object is characterized in that, in the plugged condition of the plugs, spring elements are provided at the shielding caps and are arranged such that they resiliently press against the contact elements which are conductively connected to the ground potential layer of the mother board. The contact elements are thereby directly applied to the mother board and the spring elements are directly applied to the shielding caps in order to therefore achieve an extremely short connection between shielding caps of multi-pole plugs and the mother board. Moreover, the shielding caps can extend up to the mother board and, therefore, improve the shielding of plug-type connections.

Instead of the standard contact blades as contact elements of the mother board, reinforcing plates can be provided given a suitable component spacing.

Further advantageous features may also be provided. For example, dependent upon whether the plug-type connections occur by way of cable plugs or printed circuit card plugs and without or, respectively, with centering strips, the spring elements are located at the outsides or the insides of the shielding cap. An application of spring elements both to the outsides and to the insides of the shielding caps yields, for example, electrical connections to contact blades and reinforcing plates and, therefore, leads to even lower-resistant connections to the ground potential layer of a mother board.

For reasons of space and/or for an even more effective shielding of signal lines, the contact blades which are electrically connected to the ground potential layer of the mother board and to the shielding caps can be located inside the plug regions. Contact blades lying outside of the plug regions and connected to the ground potential layer of the mother board can, for the latter reasons, also be bent in at right angles on plug-in locations of neighboring, multi-pole plug-type connections which are still free.

It can be of advantage for fabrication-oriented and cost reasons to fashion the edges of the shielding cap as spring elements.

BRIEF DESCRIPTION OF THE DRAWINGS

Other objects, features and advantages of the invention, its organization, construction and operation will be best understood from the following detailed description, taken in conjunction with the accompanying drawings, on which.

DESCRIPTION OF THE PREFERRED EMBODIMENTS

FIGS. 1–6 respectively illustrate, as mentioned above, schematic sections through the structure of shielded plug-type connections.

Figure 1:
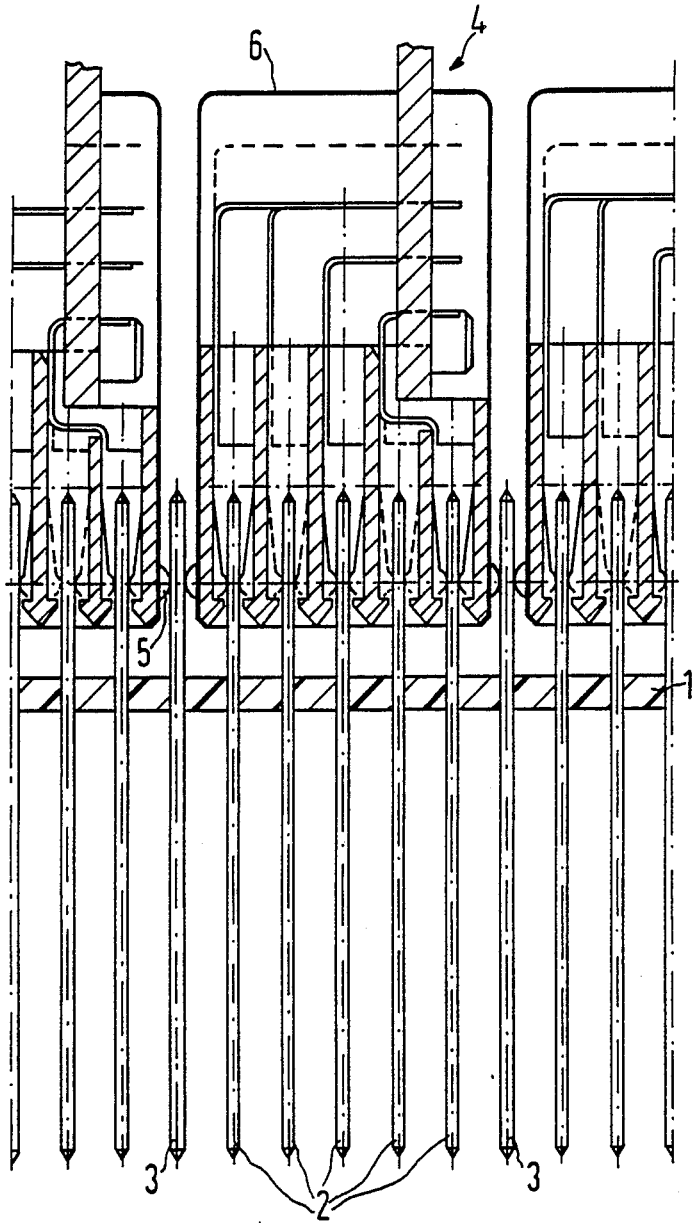
FIG. 1 is a fragmentary sectional view of an embodiment of printed circuit card plugs comprising contact blades as contact elements and spring elements at shielding caps.

The exemplary embodiment of FIG. 1 illustrates a mother board 1, which comprises a ground potential layer, and a plurality of contact blades 2, 3 extending perpendicular thereto. Multi-pole printed circuit card plugs 4 are plugged into correspondingly located contact blades 2 on the component side of the mother board. Those contact blades 3 which are electrically connected to the ground potential layer present on the mother board 1 are located between regions of the contact blades 2 for the printed circuit card plugs, these regions extending at a suitable distance. Spring elements 5 which are attached to the shielding caps 6 of adjacent printed circuit card plugs 4 resiliently press against both sides of the contact blades 3. These spring elements 5 are located at the outsides of the shielding cap 6 in the proximity of the cap edges. The roughly hemispherically-fashioned spring elements 5 are pressed against the contact blades 3, whereby the shielding caps 6 of the printed circuit card plugs 4 are electrically connected to the ground potential layer of the mother board over the shortest path. The shielding cap 6 surrounds the printed circuit card plug 4 such that it lies flush against those outside surfaces of the printed circuit card plug 4 in the plug-in direction.

Figure 2:
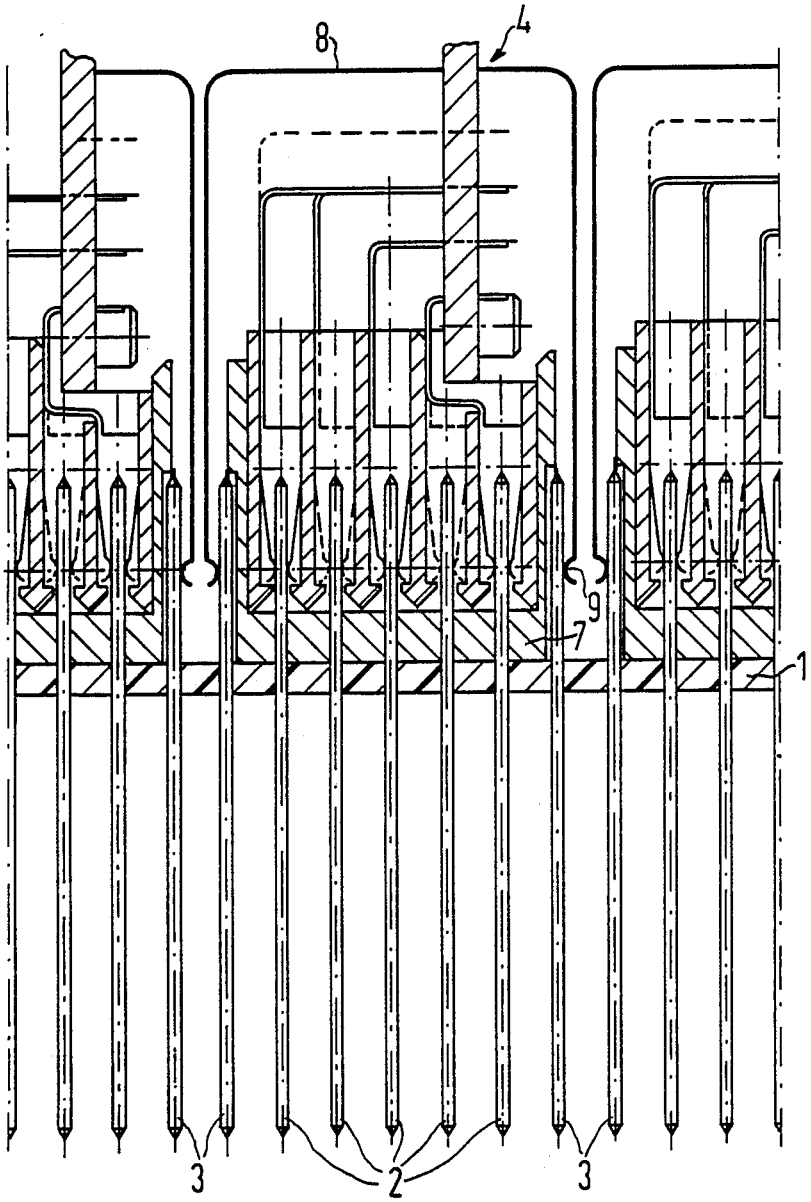
FIG. 2 is a fragmentary sectional view of an exemplary embodiment of printed circuit card plugs comprising contact blades as contact elements and spring elements at shielding caps.

Given the exemplary embodiment of FIG. 2, the mother board 1 likewise contains a plurality of contact blades 2, 3 extending perpendicularly thereto. Multipole printed circuit card plugs 4 are plugged onto correspondingly located contact blades 2 at the component side. Centering strips 7 which serve for acceptance of the printed circuit card plugs 4 are located between the printed circuit card plugs 4 and the mother board 1. The centering strip 7 is provided with clearances for the contact blades 2. The contact blades 3 electrically connected to the ground layer of the mother board 1 are located on the mother board 1 such that they partially engage into corresponding clearances of the centering strip 7. Those regions of the contact blades 3 which emerge from the outside surfaces of the centering strip 7 extending parallel to the plug-in direction serve as contact surfaces for the electrical connection to the shielding cap 8 of the printed circuit card plug 4. Those regions of the shielding caps 8 pointing in the direction of the mother board 1 thereby serve as spring elements which, arced roughly hemispherically inwardly, are located such that they press resiliently against the contact blades 3. The shielding cap 8 nearly completely envelops the printed circuit card plug including the centering strip 7. In order to improve the shielding effect of the plug connection, outside surfaces of the shielding caps 8 which extend parallel to the plug-in direction can extend up to the mother board 1.

Figure 3:
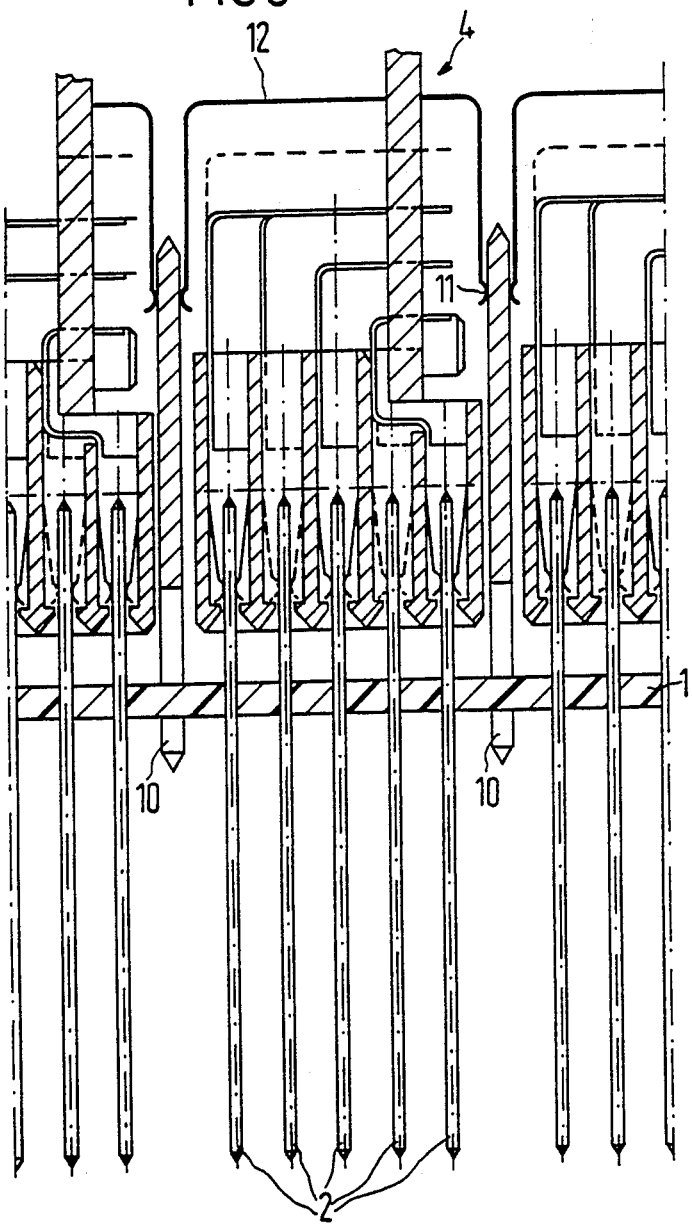
FIG. 3 is a fragmentary sectional view of an exemplary embodiment of the invention comprising reinforcing plates as contact elements between printed circuit card plugs.

FIG. 3 illustrates a mother board 1 comprising a plurality of contact blades 2 extending perpendicularly thereto. Reinforcing plates 10, which are electrically connected to the ground potential layer of the mother board 1, are located between the contact blade regions respectively assigned to adjacent printed circuit card plugs 4. Spring elements 11, arced roughly, spherically outwardly, lie at both sides of the reinforcing plates 10, the spring elements 11 being fashioned at the cap edges of the shielding caps 12 of neighboring printed circuit card plugs 4 and resiliently pressing against the reinforcing plates 10 and therefore producing the electrical connection to the shielding caps 12. Since the reinforcing plates 10 partially assume the shielding of neighboring printed circuit card plugs 4, the shielding caps 12 largely envelope those regions of the printed circuit card plugs 4 which are not so shielded.

Figure 4:
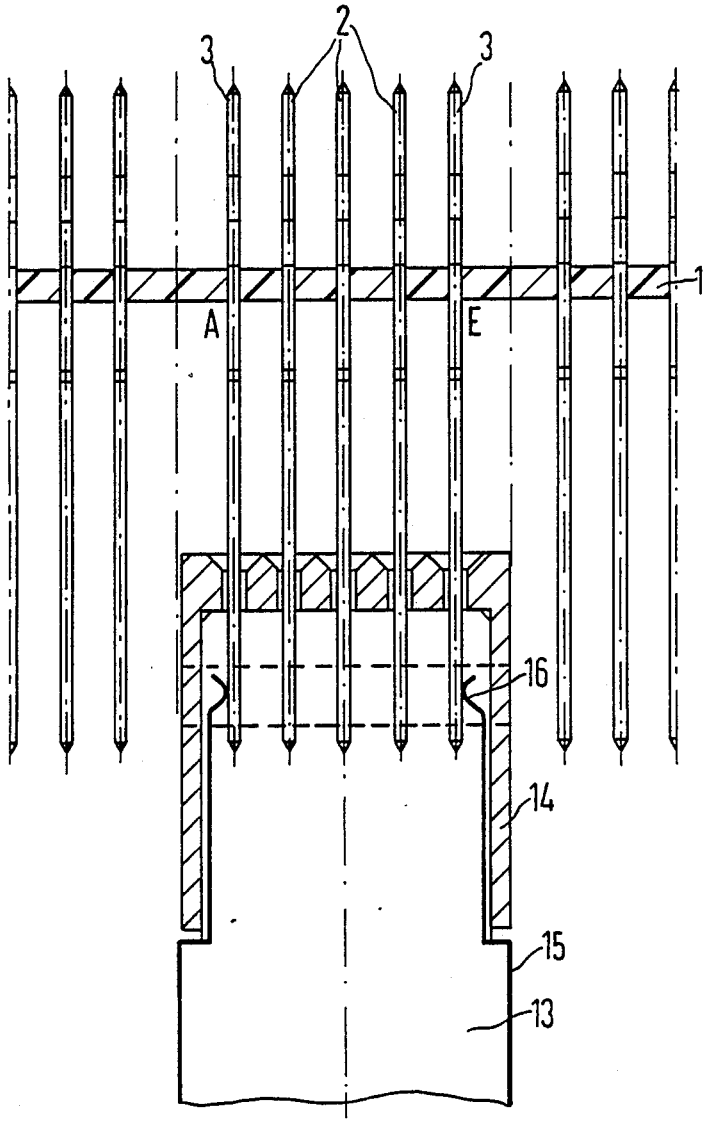
FIG. 4 is a fragmentary sectional view of an exemplary embodiment for a cable plug.

FIG. 4 illustrates an exemplary embodiment of the connection of a cable plug to a mother board 1 comprising a plurality of contact blades 2, 3 extending perpendicularly thereto. The contact blades 2 assigned to the respective cable plug 13, as well as the contact blades 3 connected to the ground potential layer of the mother board 1 and located in positions A and E are thereby situated within the contact blade region of the respective cable plug 13. A centering strip 14 which receives the cable plug 13 roughly positively locked is inserted between the cable plug 13 and the mother board 1. The centering strip 14 is provided with clearances for the contact blades 2, 3. The spacing between the centering strip 14 and the mother board 1 derives from the fastenings (not shown) of the centering strip 14. The cable plug 13 is surrounded by a shielding cap 15 at whose cap edges spring elements 16 are fashioned such that they resiliently press against those contact blades 3 which are electrically connected to the ground potential layer of the mother board 1. The cable plugs 13 comprise corresponding clearances for receiving the spring elements 13. The roughly hemispherically fashioned spring element 16 point in the direction of the neighboring contact blade 3.

Figure 5:
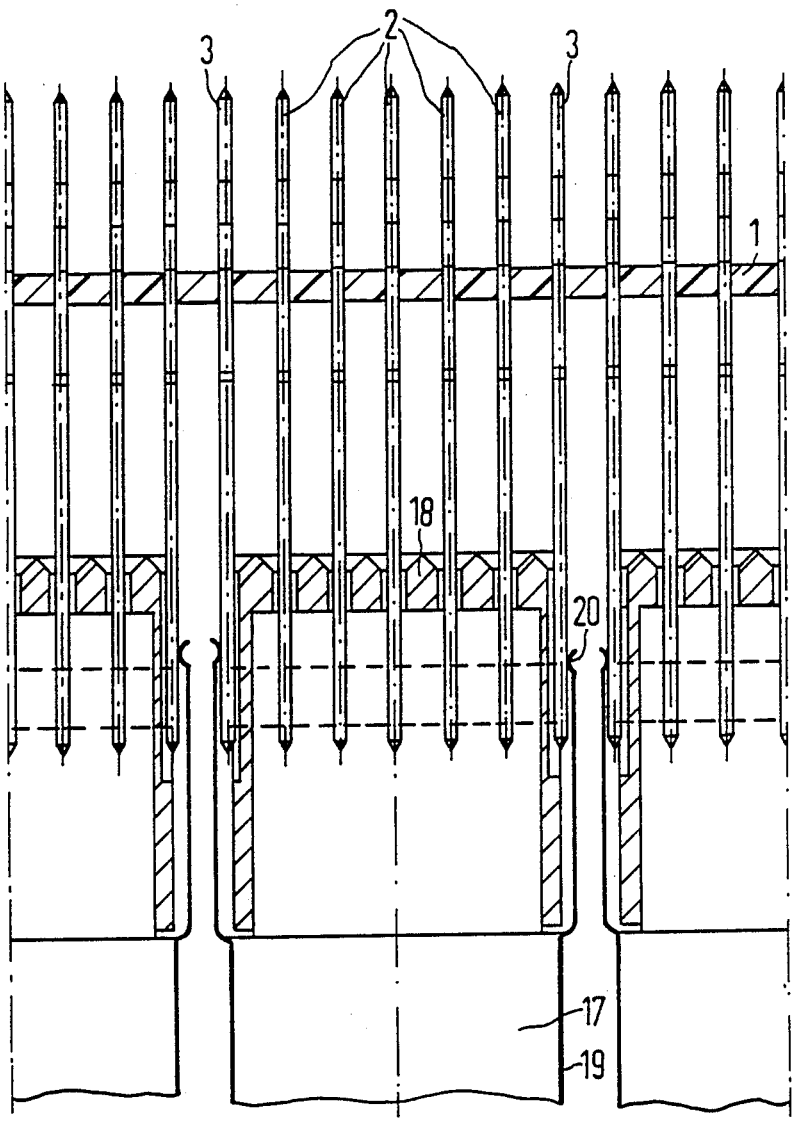
FIG. 5 is a fragmentary sectional view of another exemplary embodiment for cable plugs.
Figure 6:
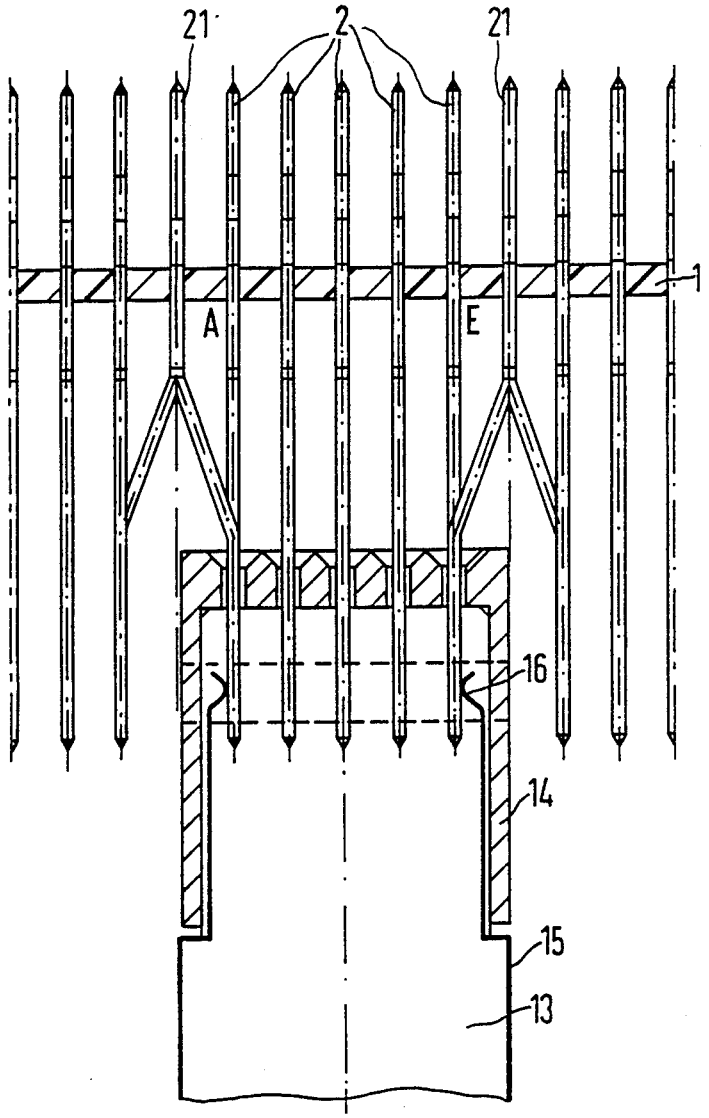
FIG. 6 is a sectional view of a still further exemplary embodiment for cable plugs.

FIG. 5 illustrates a further exemplary embodiment of the connection of cable plugs to a mother board 1 which comprises a plurality of contact blades 2, 3 extending perpendicularly thereto. Centering strips 18 which receive the cable plug 17 roughly positively locked are inserted between the cable plug 17 and the mother board 1. The centering strips 18 are provided with clearances for the contact blades 2. The spacing between the centering strips 18 and the mother board 1 derives from the fastening (not shown) of the centering strips 18. The contact blades 3 electrically connected to the ground potential layer of the mother board 1 are placed on the mother board 1 such that they partially engage into corresponding clearances of the centering strip 18. Those regions of the contact blades 3 which emerge from the outside of the centering strips 18 extending parallel to the plug-in direction serve as contact surfaces for the electrical connection to the shielding cap 19 of the cable plug 17. Those edges of the shielding cap 19 pointing in the direction towards the mother board 1 are fashioned as spring elements 20 such that they resiliently press against the contact blades 3. The spring elements 20 are arced roughly hemispherically in the direction towards the inside of the shielding caps 19. The shielding caps 19 nearly completely surround the cable plug 17, including the centering strips 18. In order to improve the shielding effect of the plug-type connection, the outsides of the shielding caps 19 extend up to the end of the centering strip 18 or beyond, for example extending at a maximum to the mother board 1.

In the exemplary embodiment of FIG. 6, the mother board 1 again comprises a plurality of contact blades 2, 21 extending perpendicularly thereto. Each contact blade 21, arranged between the contact blade regions of the respective cable plug 13 and connected to the ground potential layer of the mother board 1, is bent in twice at an obtuse angle onto a contact blade position in the contact blade row A or E of a cable plug 13 which is not provided with a contact blade 2 or which is kept free therefor, being bent in such a way that the portion of the contact blade 21 projecting into the centering strip 14 extends perpendicular to the mother board 1. The further design of this exemplary embodiment corresponds to that of FIG. 5.

According to the invention, further structures can be achieved by combining the exemplary embodiments set forth in FIGS. 1–6, particularly in view of an even more effective shielding of plugs by a plurality of electrical connections from the shielding caps of the plugs to the ground potential layer of the mother board.

Although we have described our invention by reference to particular illustrative embodiments thereof, many changes and modifications of the invention may become apparent to those skilled in the art without departing from the spirit and scope of the invention. We therefore intend to include within the patent warranted hereon all such changes and modifications as may reasonably and properly be included within the scope of our contribution to the art.

We claim:

1. Apparatus for shielding a multi-pole printed circuit card plug to a ground potential layer, comprising:

a mother board including the ground potential layer thereon;

a plurality of first contact elements perpendicularly extending to and through said mother board;

a plurality of second contact elements perpendicularly extending through and to said mother board and electrically connected to the ground potential layer;

a multi-pole connector plug including a plurality of third contact elements for respectively engaging said first contact elements when said multi-pole connector plug is plugged into said first and second contact elements; and a conductive shielding cap mounted on said multi-pole connector plug and including spring elements for resiliently engaging said second contact elements when said multi-pole connector plug is plugged onto said first and second contact elements, said conductive shielding cap and said spring elements being of unitary formation, said shielding cap having shaped edges forming said spring elements.

2. The apparatus of claim 1, wherein:

each of said second contact elements is a contact blade.

3. The apparatus of claim 1, wherein:

each of said second contact elements is a reinforcing plate constituting a portion of a shielding.

4. The apparatus of claim 1 wherein:

said spring elements are on the inside of said conductive shielding cap.

5. The apparatus of claim 1 wherein:

said spring elements are on the outside of said shielding cap.

6. The apparatus of claim 1 wherein, in the plugged condition, the multi-pole connector plug covers a defined region of the mother board, and wherein:

said plurality of second contact elements is mounted within the defined region.

7. The apparatus of claim 1 wherein, in the plugged condition, the multi-pole connector plug covers a defined region of the mother board, and wherein:

said plurality of second contact elements is mounted outside of the defined region.

8. The apparatus of claim 1 wherein:

said conductive shielding cap comprises shaped edges constituting said spring elements.

9. An apparatus for shielding a multi-pole printed circuit card to a ground potential layer, comprising:

a mother board including the ground potential layer thereon;

a plurality of first contact elements perpendicularly extending to and through said mother board;

a plurality of second contact elements perpendicularly extending through and to said mother board and electrically connected to the ground potential layer;

a multi-pole including a plurality of third contact elements for engaging said first contact elements when said multi-pole connector plug is plugged onto said first and second contact elements; and a conductive shielding cap mounted on said multi-pole connector plug having shaped edges forming spring elements unitarily formed therewith, said spring elements resiliently engaging said second contact elements when said multi-pole connector plug is plugged onto said first and second contact elements, and the shaped edges at opposite sides of the shielding cap being symmetrical and cross-sectional profile.

* * * * *